US007765972B2

(12) United States Patent
Hofbauer

(10) Patent No.: US 7,765,972 B2
(45) Date of Patent: Aug. 3, 2010

(54) FULLY VARIABLE MECHANICAL VALVE TRAIN IN AN INTERNAL COMBUSTION ENGINE

(75) Inventor: Peter Hofbauer, West Bloomfield, MI (US)

(73) Assignee: FEV Engine Technology, Inc, Auburn Hills, MI (US)

( * ) Notice: Subject to any disclaimer, the term of this patent is extended or adjusted under 35 U.S.C. 154(b) by 511 days.

(21) Appl. No.: 11/780,168

(22) Filed: Jul. 19, 2007

(65) Prior Publication Data

US 2008/0017148 A1 Jan. 24, 2008

Related U.S. Application Data

(60) Provisional application No. 60/832,360, filed on Jul. 21, 2006.

(51) Int. Cl.
*F01L 1/18* (2006.01)

(52) U.S. Cl. ..... 123/90.39; 123/90.16; 123/90.44; 74/569

(58) Field of Classification Search ..... 123/90.39, 123/90.44, 90.16, 90.27, 90.31; 74/559, 74/567, 569

See application file for complete search history.

(56) References Cited

U.S. PATENT DOCUMENTS 5,681,986 A 10/1997 Merk et al.
5,940,347 A 8/1999 Raida et al.
6,745,733 B2 6/2004 Hendriksma
6,829,197 B2 12/2004 Erikson
7,146,966 B2 * 12/2006 Nakamura ..... 123/481

FOREIGN PATENT DOCUMENTS

JP 2006057535 3/2006
WO WO-02/075362 9/2002

OTHER PUBLICATIONS

Printout from website dated Nov. 29, 2007: http://en.wikipedia.org/wiki/Variable_displacement.
Printout of website dated Nov. 29, 2007: http://en.wikipedla.org/wiki/Multi-Displacement_System.

* cited by examiner

*Primary Examiner*—Ching Chang
(74) *Attorney, Agent, or Firm*—Gifford, Krass, Sprinkle, Anderson & Citkowski, P.C.

(57) ABSTRACT

A variable mechanical valve train for actuating a valve in an internal combustion engine includes a two-part follower operatively coupled between a cam shaft and a valve, so that the follower: in a fully-activated mode, causes a maximum lift of the valve in response to a rotation of the cam shaft; in a partial load mode, collapses partially so as to cause a partial valve lift during the rotation of the cam shaft; and in a deactivated mode, collapses in response to the rotation of the cam resulting in no valve lift.

17 Claims, 4 Drawing Sheets

FULLY VARIABLE MECHANICAL VALVE TRAIN IN AN INTERNAL COMBUSTION ENGINE

REFERENCE TO RELATED APPLICATIONS

This application claims priority to U.S. provisional patent application No. 60/832,360, which was filed Jul. 21, 2006 and is incorporated herein by reference in its entirety.

FIELD OF THE INVENTION

The invention relates to a fully variable mechanical valve train in an internal combustion engine.

BACKGROUND OF THE INVENTION

When fuel costs are high, the demand for high power or high performance vehicles typically decreases in favor of more fuel efficient vehicles. Adding or combining technologies, such as diesel combustion, turbo charging, and supercharging, can result in increases in fuel economy with minimal sacrifice in power and performance. Variable displacement engine systems have been introduced to address the balance between high power or performance and fuel efficiency by automatically deactivating banks or opposing pairs of cylinders during low-demand operation, such as highway cruising, and reactivating the cylinders during high-demand operation, such as when passing on the highway or accelerating from a stop.

One of the first variable displacement systems was developed by General Motors in the early 1990's and was called Displacement on Demand (OD). The DOD system was first used in the Cadillac L62 "V8-6-4" engine, in which opposite pairs of cylinders could be turned off and on allowing the engine to have three different modes of operation, i.e. 8, 6 and 4 cylinders. The DOD system proved to be troublesome and was retired after a short production run due to a poor service record.

Similar approaches were used by Chrysler in its Hemi V8 engine (Multiple Displacement System or "MDS"), by Mercedes in its 600 series 5.8L V12 engine (Active Cylinder Control or "ACC"), and by Honda in its i-VTEC 3.5L V6 engine (Variable Cylinder Management or "VCM").

It remains desirable to provide a mechanism for deactivating and reactivating valves on-demand that improves over previous variable displacement designs in terms of performance, efficiency and robustness.

SUMMARY OF THE INVENTION

According to one aspect of the invention, a variable mechanical valve train is provided for actuating a valve in an internal combustion engine. The variable mechanical valve train includes a two-part follower operatively coupled between a cam shaft and a valve, so that the follower: in a fully-activated mode, causes a maximum lift of the valve in response to a rotation of the cam shaft; in a partial load mode, collapses partially so as to cause a partial valve lift during the rotation of the cam shaft; and in a deactivated mode, collapses in response to the rotation of the cam resulting in no valve lift.

BRIEF DESCRIPTION OF THE DRAWINGS

Advantages of the present invention will be readily appreciated as the same becomes better understood by reference to the following detailed description when considered in connection with the accompanying drawings, wherein.

DETAILED DESCRIPTION OF THE INVENTION

The invention provides a mechanical valve train that allows on-demand and continuous decrease and increase of valve-lift in an internal combustion engine. The valve train utilizes a two-part follower that in a fully activated mode operates to cause a maximum lift of the valve in response to rotation of a cam and in a partial load mode collapses partially so as to cause a partial valve lift during the rotation of the cam. The on-demand valve lift mechanism is described in greater detail below.

Figures 1A, 1B, 1C:
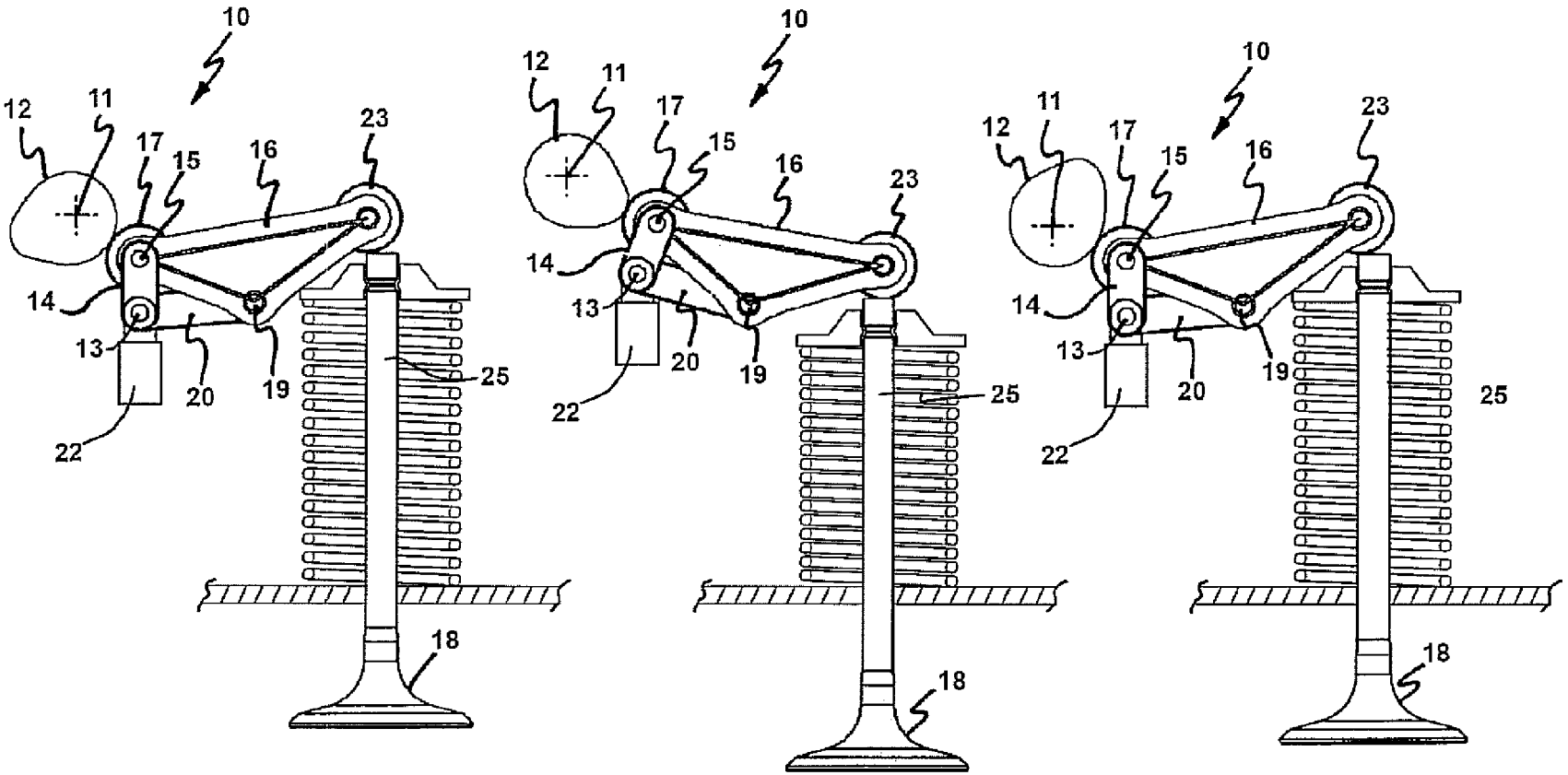
FIG. 1 is a side view of an on-demand valve lift mechanism or valve train according to one embodiment, with the mechanism shown in a fill-lift condition.
Figures 2A, 2B, 2C:
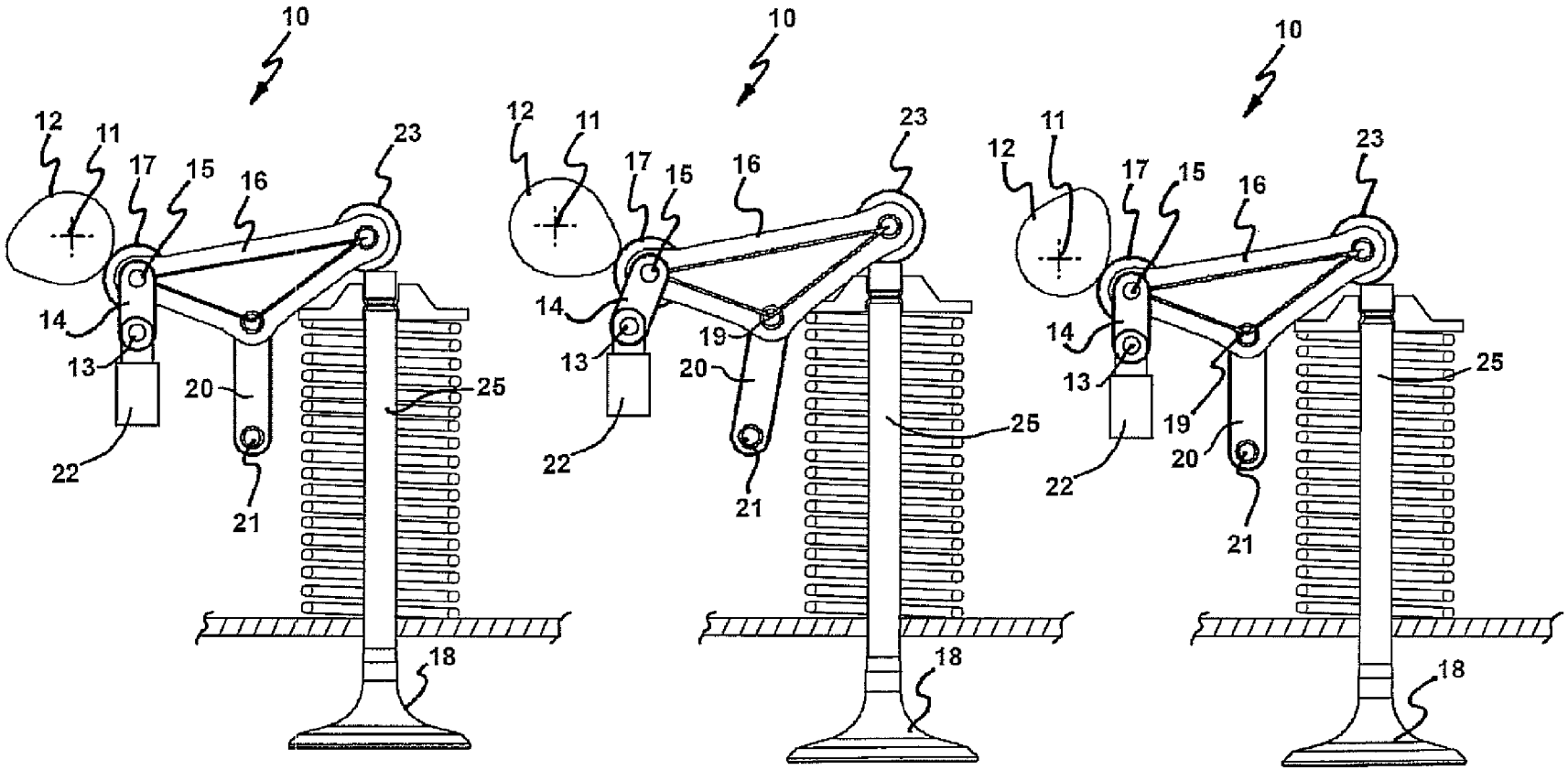
FIG. 2 is a side view of the valve train shown in a no-lift condition.
Figures 3A, 3B, 3C:
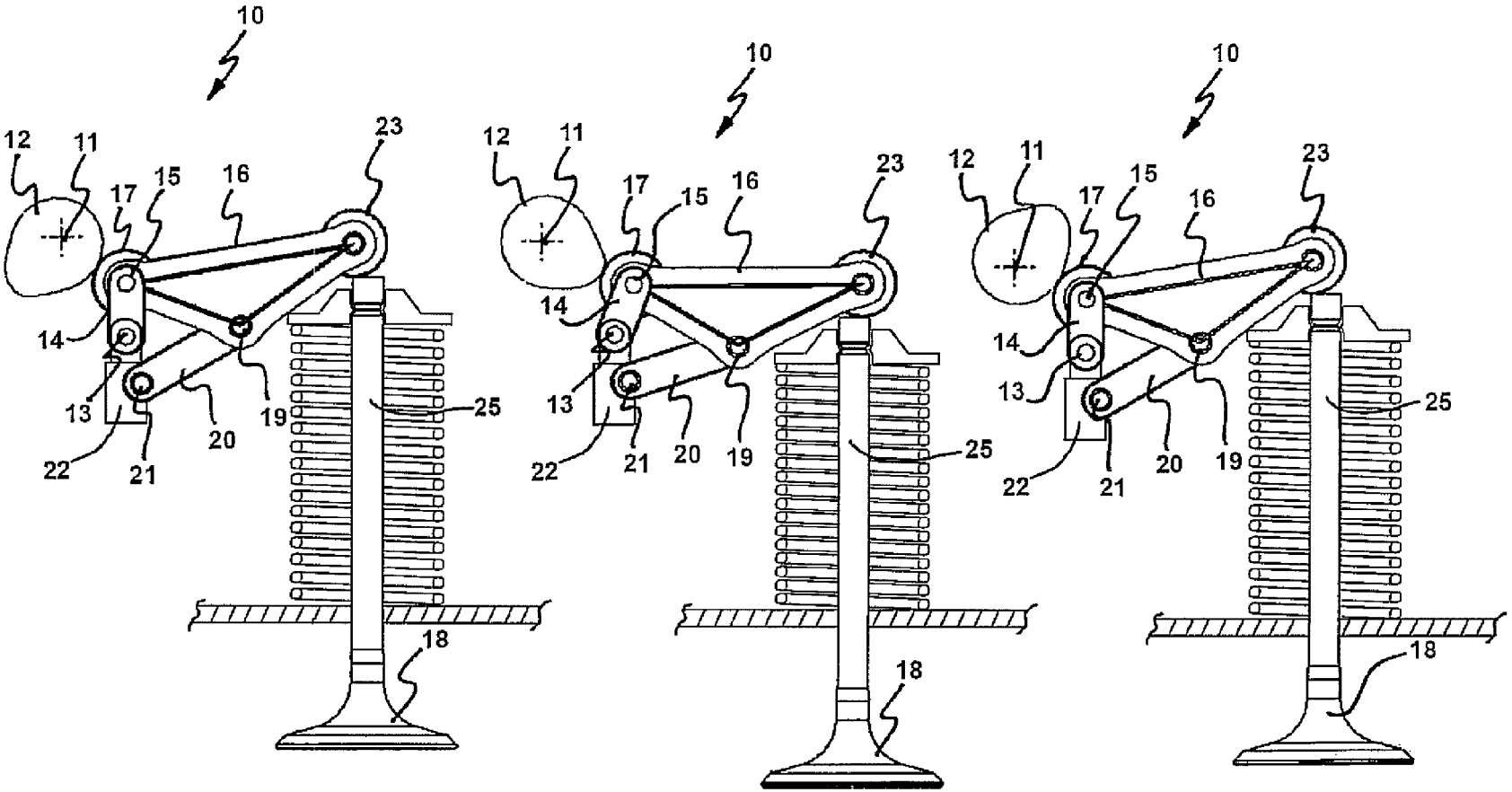
FIG. 3 is a side view of the valve train shown in an intermediate lift condition.

Referring to FIGS. 1-3, the valve train according to one embodiment is generally indicated at 10. The valve train 10 includes first 14 and second 16 follower arms each having opposite outer and inner ends. The outer end of the first follower arm 14 is pivotally coupled to the engine for movement about a pivot 13. The outer end of the second follower arm 16 is in mechanical communication with a stem 25 of a valve 18 and transfers the axial component of the movement of the second follower arm 16 to cause axial displacement of the valve 18. In one embodiment, a roller 23 is rotatably connected to the outer end of the second follower arm 16 and engaged with the end of the valve stem 25. The roller 23 accommodates the transverse component of the movement of the second follower arm 16 relative to the valve stem 25. The inner ends of the follower arms 14, 16 are pivotally coupled to each other by a pivot pin 15. A cam follower 17 is pivotally coupled to the inner ends of the follower arms 14, 16 by the pivot pin 15. The cam follower 17 is rollingly engaged with a cam shaft 12 that is rotatable about a fixed axis 11. The cam follower 17 remains engaged with the cam shaft 12 and the roller 23 remains rollingly engaged with the end of the valve stem 25 due, at least in part, to the bias of the valve return spring on the valve 18.

A lever 20 is pivotally coupled to the second follower arm 16 by a pivot pin 19. The lever 20 is moveable about the pivot pin 19 between a full activated position, as shown in FIG. 1, a deactivated position, as shown in FIG. 2, and any one of a plurality of intermediate positions therebetween, as illustrated in FIG. 3. The lever 20 may be maintained and moved between these positions by an actuator. The actuator (not shown) may provided in the form of a hydraulic actuator, electric motor, or other suitable actuating devices. The operation of the actuator may be controlled by a controller (not shown), so as to be responsive to the needs of the engine.

In the full activated position (FIG. 1), the lever 20 prevents relative pivotal movement between the first 14 and second 16 follower arms relative to each other. The follower arms 14, 16 function as a single lever that moves about the pivot 13 to actuate the valve 18 in response to the engagement between the rotating cam shaft 12 and the cam follower 17.

In the deactivated position (FIG. 2), the lever 20 functions as a member of a multi-linkage mechanism 14, 16, 20 moving about the pivots 13, 15, 19, 21. In this position, the first 14 and second 16 follower arms are allowed to pivot relative to each other about the pivot pin 15 and no longer function as a single lever to actuate the valve 18. Thus, the engagement between the rotating cam shaft 12 and the cam follower 17 results in relative movement of the follower arms 14, 16 relative to each other about the pivot pin 15 rather than actuation of the valve 18.

In any one of the intermediate positions (as illustrated in FIG. 3), the lever 20 allows some relative movement between the follower arms 14, 16 and some displacement of the valve 18 in response to engagement between the rotating cam shaft 12 and follower 17. The amount of relative movement between the follower arms 14, 16 and the amount of displacement of the valve 18 depends on which intermediate position the lever 20 is maintained. The amount of displacement of the valve 18 in response to the engagement between the cam shaft 12 and follower 17 decreases as the lever 20 is positioned from the full activated position (FIG. 1) and shifted toward the deactivated position (FIG. 2).

In the illustrated embodiment, a lash adjuster 22 may be provided for adjusting valve lash. The lash adjuster 22 may be of any suitable type, such as hydraulic, as shown, mechanical or electro-mechanical. The pivotal connection of the first follower arm 14 at the pivot 13 is defined by a ball head at an actuated or movable end of the lash adjuster 22.

Figure 4:
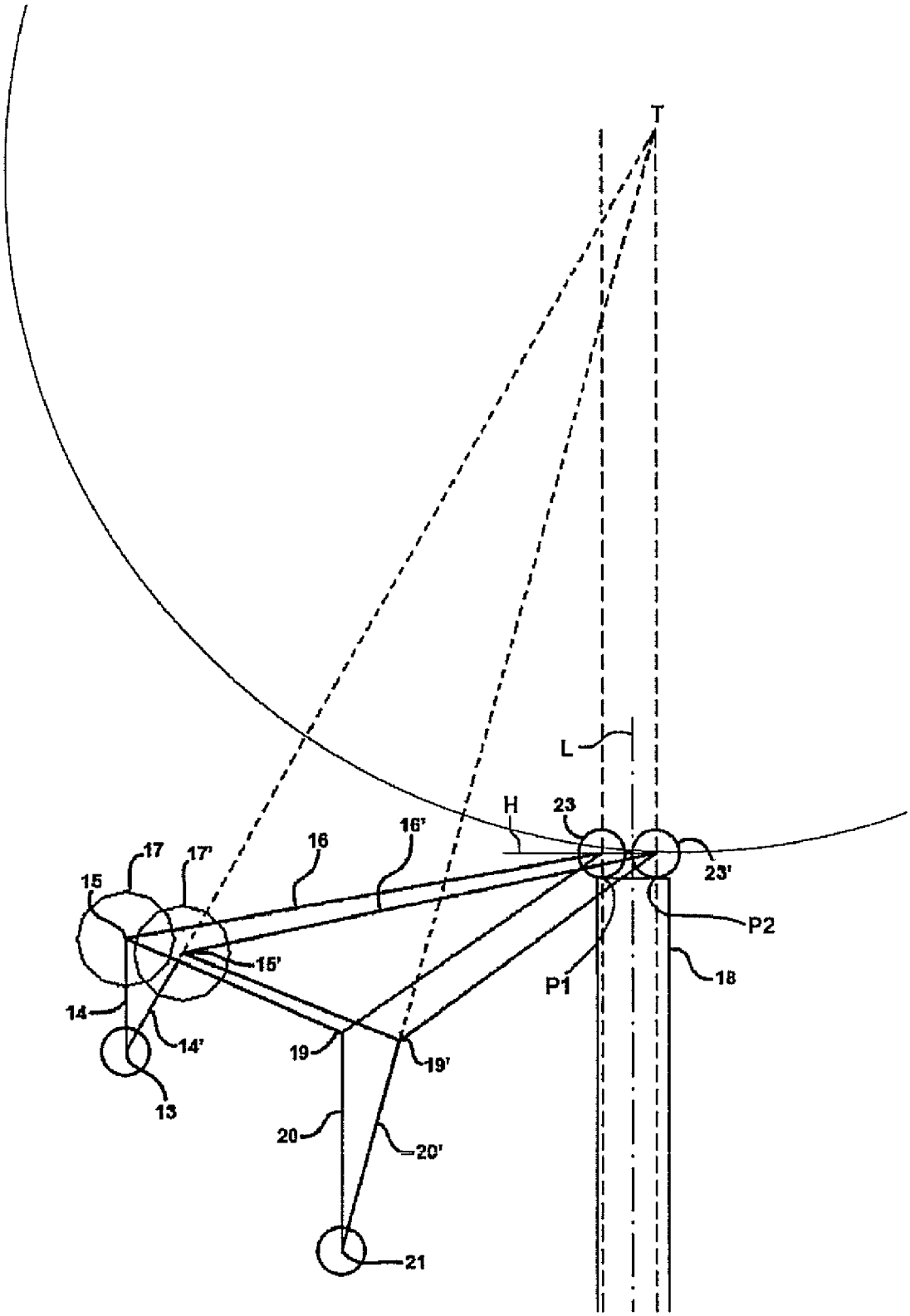
FIG. 4 is a schematic view illustrating the valve train in the no-lift condition.

In FIG. 4, a schematic of the valve train 10 is shown in the deactivated position. As the linkage 14, 16, 20 moves in response to the rotation of the cam shaft 12 and the periodic engagement the cam shaft 12 and the cam follower 17, the roller 23 should preferably travel substantially perpendicular to the longitudinal axis of the valve stem 25. Maintaining the movement of the roller 23 along a path that is substantially perpendicular to the longitudinal axis of the valve stem 25 ensures that the ball head of the lash adjuster 22 is maintained in at least an optimal position to avoid a several potential issues, including the formation of gaps in the valve actuation mechanism, undesired valve lift and/or noise in the valve train. General considerations for designing such a valve train are as follows.

To create a substantially perpendicular motion of the roller 23 along the end of the valve 18, a momentary center of rotation or pole is defined along a line that is generally parallel with the axis L of the valve 18 and extending through a first contact point P1 where the gliding element or, illustratively, the roller 23 is touching the end of the valve 18.

Preferably, the pole should be located above the first contact point P1 disposed along a line generally parallel with the axis L. In one embodiment, the pole corresponding to the first contact point P1 may be chosen at or near infinity, wherein the first follower arm 14 and the lever 20 are substantially parallel to the longitudinal axis L of the valve 18. The second follower arm 16 would then be designed so that the roller 23 is in contact with the first contact point P1 on the valve 18. By this arrangement, the roller 23 would move momentarily along a line H perpendicular to the axis L of the valve 18, since the arc resulting from a pole at or near infinity is virtually a straight line.

The kinematics of the arms 14, 16 and lever 20 allows one to choose another position where the pole T is above a second contact point P2 on the valve 18 and along a line generally parallel with the axis L. In this case, the roller 23' would move on along a circular path C centered about this pole T and passing tangentially through this second contact point P2. The momentarily pole T could be found by extending the arm 14' and lever 20', as indicated by the extended hashed lines. The intersection of the extended lines is the momentary pole T of the roller 23' at the second touch point P2.

It should be appreciated that contact points for tie roller 23, 23' on the valve 18, i.e. P1 and P2, can be selected anywhere along the end of the valve 18. The choice of contact points P1, P2 depends largely on the requirements of the specific application. For any chosen set of contact points P1 P2, the corresponding selected poles should be as far away the contact points P1, P2, as allowed by the a particular design for a particular application, in order to ensure that the roller 23, 23' travels as closely along the straight line H as possible.

By dimensioning the linkage 14, 16, 20 so that the poles remain as far above the first and second contact points P1, P2 as possible during lie movement of the linkage 14, 16, 20, the valve train can be designed with the result that the travel of roller 23 is virtually straight and differs only on the order of micro millimeters from the ideal straight path H that is perpendicular to the axis L of the valve 18.

The invention has been described in an illustrative manner. It is, therefore, to be understood that the terminology used is intended to be in the nature of words of description rather than of limitation. Many modifications and variations of the invention are possible in light of the above teachings. Thus, within the scope of the appended claims, the invention may be practiced other than as specifically described.

I claim:

1. A variable mechanical valve train for actuating a valve in an internal combustion engine, said valve train comprising:

a two-part follower operatively coupled between a cam shaft and a valve, so that the follower: in an activated mode, causes a maximum lift of the valve in response to a rotation of the cam shaft; in a partial load mode, collapses partially so as to cause a partial valve lift during the rotation of the cam shaft; and in a deactivated mode, collapses in response to the rotation of the cam resulting in no valve lift, wherein the two-part follower includes a first follower arm and a second follower arm pivotally coupled to each other at a first pivot, wherein the first follower arm is pivotally coupled to the engine at a second pivot, wherein the second follower arm is mechanically coupled to the valve by a gliding element, and including a cam follower rotatably coupled at the first pivot and rollingly engaged with the cam shaft.

2. The variable mechanical valve train as set forth in claim 1, wherein the gliding element is a roller.

3. The variable mechanical valve train as set forth in claim 1 including a lever having one end pivotally coupled to the second follower arm at a third pivot and an opposite end pivotally coupled to the engine at a fourth pivot.

4. The variable mechanical valve train as set forth in claim 3, wherein the fourth pivot is movable and the lever movable about the third pivot between:

an activated position wherein the first and second follower arms move together about the second pivot to actuate the valve in response to a displacement of the cam follower due to a rolling engagement between the cam follower and the rotating cam shaft; and a deactivated position wherein a displacement of the cam follower due to a rolling engagement between the cam follower and the rotating cam shaft results in pivotal movement of the first and second follower arms relative to each other about the first pivot.

5. The variable mechanical valve train as set forth in claim 4, wherein the lever is movable to an intermediate position between the activated position and the deactivated position to cause a proportional partial actuation of the valve in response to the displacement of the cam follower due to the rolling engagement between the cam follower and the rotating cam shaft.

6. The variable mechanical valve train as set forth in claim 4, wherein the movement of the gliding element in the deactivated mode is substantially orthogonal to the longitudinal axis of the valve stem.

7. The variable mechanical valve train as set forth in claim 4, wherein the first follower arm and the lever each extend along respective lines that intersect at a momentary pole.

8. The variable mechanical valve train as set forth in claim 7, wherein the momentary pole is disposed along a line that extends through a contact point between the glider element and the valve.

9. The variable mechanical valve train as set forth in claim 8, wherein the line extending through the pole and the contact point remains substantially parallel with the longitudinal axis of the valve in the deactivated mode.

10. The variable mechanical valve train as set forth in claim 4, wherein the first follower arm and the lever extend along respective lines that are parallel to each other for at least one position of the glider element relative to the valve.

11. The variable mechanical valve train as set forth in claim 4, wherein the first follower arm and the lever extend along respective lines that are nearly parallel to each other for at least one position of the glider element relative to the valve, so that the lines intersect at a momentary pole.

12. The variable mechanical valve train as set forth in claim 11, wherein the momentary pole being disposed along a line that extends through the at least one position and is generally parallel with the longitudinal axis of the valve.

13. The variable mechanical valve train as set forth in claim 4, wherein the lever is movable by an actuator.

14. The variable mechanical valve train as set forth in claim 13, wherein the lever is actuated automatically in response to a control.

15. The variable mechanical valve train as set forth in claim 1, wherein the second pivot is located on an actuated end of a lash adjuster.

16. A variable mechanical valve train for actuating a valve in an internal combustion engine, said valve train comprising:

a two-part follower operatively coupled between a cam shaft and a valve, so that the follower: in an activated mode, causes a maximum lift of the valve in response to a rotation of the cam shaft; in a partial load mode, collapses partially so as to cause a partial valve lift during the rotation of the cam shaft; and in a deactivated mode, collapses in response to the rotation of the cam resulting in no valve lift, wherein the two-part follower includes a first follower arm and a second follower arm pivotally coupled to each other at a first pivot, wherein the first follower arm is pivotally coupled to the engine at a second pivot, and wherein the second pivot is located on an actuated end of a lash adjuster.

17. A variable mechanical valve train for actuating a valve in an internal combustion engine, said valve train comprising:

a first follower arm having one end pivotally connected to said engine about a first pivot point and a cam follower mounted to its other end about a second pivot point, an elongated second follower arm having one end pivotally connected to said cam follower at said second pivot point and mechanically coupled to the valve at its other end, and an actuator lever pivotally connected to said second follower arm at a third pivot point, wherein the pivotal position of said actuator lever around said third pivot point varies the magnitude of actuation of the valve.

* * * * *